United States Patent [19]

Geddes

[11] Patent Number: 5,063,598

[45] Date of Patent: Nov. 5, 1991

[54] ACTIVE NOISE CONTROL SYSTEM WITH TWO STAGE CONDITIONING

[75] Inventor: Earl R. Geddes, Livonia, Mich.

[73] Assignee: Ford Motor Company, Dearborn, Mich.

[21] Appl. No.: 514,386

[22] Filed: Apr. 25, 1990

[51] Int. Cl.[5] ..... G10K 11/16

[52] U.S. Cl. ..... 381/71

[58] Field of Search ..... 381/71; 181/206

[56] References Cited

U.S. PATENT DOCUMENTS

| | | |
|---|---|---|
| 4,153,815 | 5/1979 | Chaplin et al. . |
| 4,473,906 | 9/1984 | Warnaka et al. . |
| 4,480,333 | 10/1984 | Ross . |
| 4,669,122 | 5/1987 | Swinbanks . |
| 4,677,676 | 6/1987 | Eriksson . |
| 4,677,677 | 6/1987 | Eriksson . |
| 4,736,431 | 4/1988 | Allie et al. . |
| 4,783,817 | 11/1988 | Hamada et al. . |
| 4,805,733 | 2/1989 | Kato et al. . |
| 4,815,139 | 3/1989 | Eriksson et al. . |
| 4,837,834 | 6/1989 | Allie . |
| 4,876,722 | 10/1989 | Dekker et al. . |
| 4,878,188 | 10/1989 | Ziegler, Jr. . |

FOREIGN PATENT DOCUMENTS 2191063A 12/1987 United Kingdom .

*Primary Examiner*—Forester W. Isen

*Attorney, Agent, or Firm*—Mark L. Mollon; Roger L. May

[57] ABSTRACT

An active muffler for motor vehicle exhaust conduits comprises a pulse tracking sensor generating a signal input to an electronic control for actuating an acoustic transducer imposing cancellation pulses upon the sound pressure pulse train travelling through the conduit. The system includes a preconditioning circuit for reducing the crest factor of the waveform pulse train travelling through the exhaust conduit by introducing negative pressure pulses into the exhaust conduit. Preferably, a digitally controlled one bit injector includes a fluid outlet in communication with the exhaust conduit and an inlet in communication with a vacuum source such as the intake manifold of the motor vehicle engine. Accordingly, the amplifier and the transducer of the acoustic actuator can be substantially downsized for employment in mass produced motor vehicles.

9 Claims, 2 Drawing Sheets

FIG 1
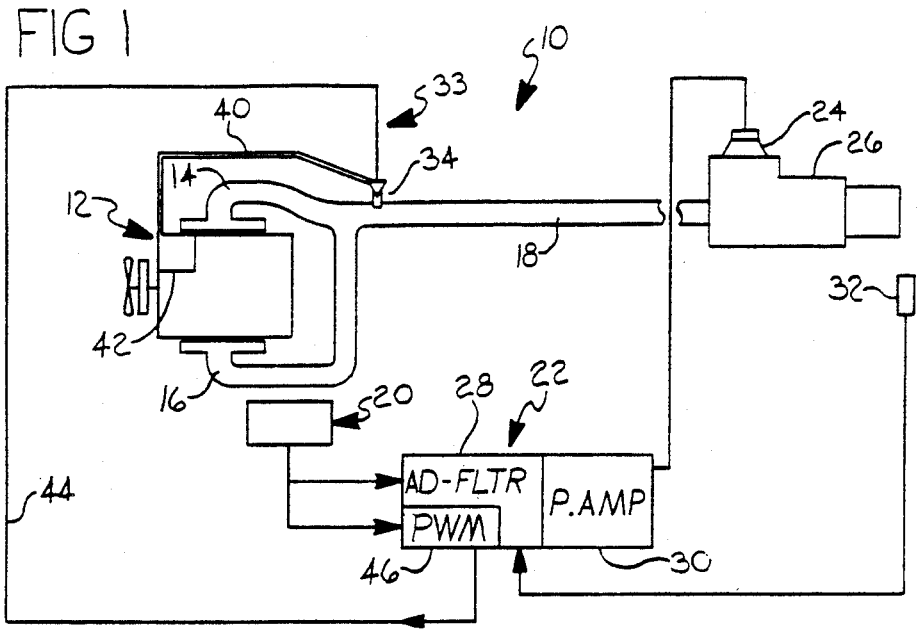
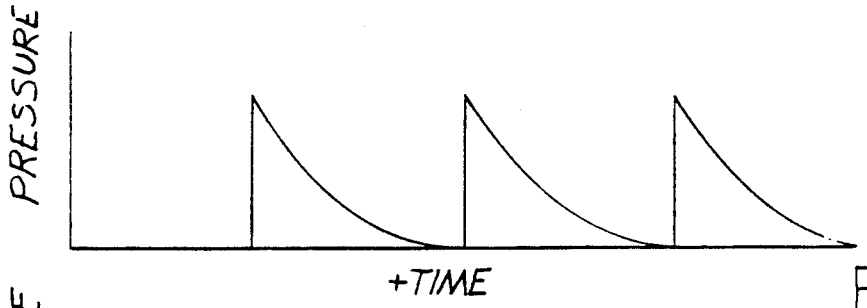
FIG 2
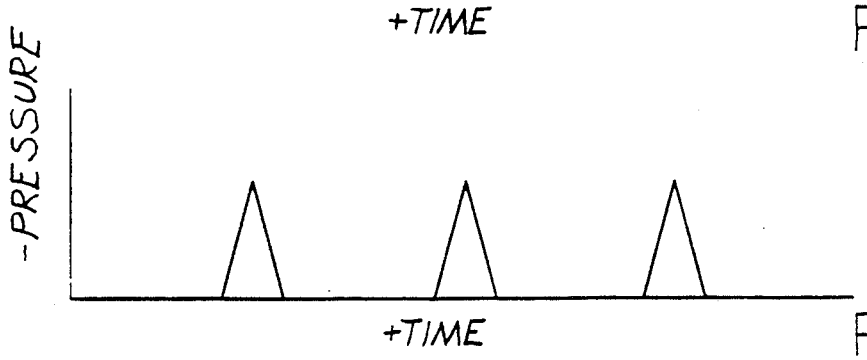
FIG 3
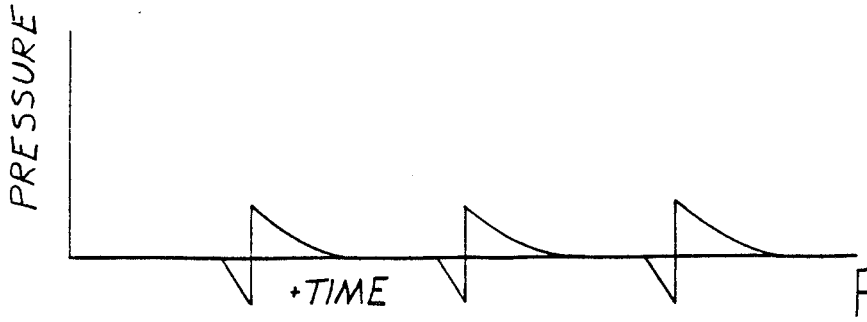
FIG 4

ACTIVE NOISE CONTROL SYSTEM WITH TWO STAGE CONDITIONING

TECHNICAL FIELD

The present invention relates generally to active noise cancellation systems, and more particularly to an active muffler for use in a motor vehicle employing two stages of conditioning for the signal delivered to the cancellation pulse transducer.

BACKGROUND ART

Although active noise cancellation systems are well known for use with the ventilation ducts of buildings, such systems have not been found to be readily applicable to noise reduction as a substitute for passive mufflers in motor vehicles. In addition to packaging problems relating to acoustical coupling between the transducers and the high temperature exhaust conduit, exposure to harsh environmental conditions and vulnerability to contact with foreign objects, these problems must be addressed economically so that the noise cancellation system can be implemented in a mass production process without substantially increasing the cost of manufacturing or installing the components.

U.S. Pat. No. 4,473,906 to Wanaka et al discloses numerous prior art sound attenuation system embodiments. The patent discusses the inclusion of additional transducers and electronic controls to improve the performance of the active acoustic attenuator, by reducing the effect of the feedback of the cancellation signal which arrives at the sensor.

U.S. Pat. No. 4,677,677 to Erickson further improves attenuation by including an adaptive filter with on-line modeling of the error path and the cancelling speaker by using a recursive algorithm without dedicated off-line pretraining. U.S. Pat. No. 4,677,676 adds a low amplitude, uncorrelated random noise source to a system to improve performance. Likewise, U.S. Pat. Nos. 4,876,722 to Decker et al and 4,783,817 to Hamada et al disclose particular component locations which affect performance. These patents do not teach or suggest the adaption of active attenuator noise control systems to motor vehicles.

It will be appreciated that the sound pressure pulses emitted from the transducer must be of sufficient power to cancel out the sound pressure pulses travelling through the exhaust conduit. In order to initiate the high energy pulses required to cancel the high level of sound emanating from the motor vehicle engine, a relatively large amplifier is required to drive the transducer. In addition, the transducer must be capable of withstanding the power provided by the amplifier. Moreover, the electro mechanical transducer and the power amplifier are substantially higher cost hardware items than the other components of the noise attenuation system. Accordingly, the power requirements for a system intended to be used as a motor vehicle muffler directly conflict with the lack of packaging space and the need for minimizing production costs of motor vehicles, and represents a substantial impediment to the incorporation of such systems in a motor vehicle.

SUMMARY OF THE INVENTION

The present invention permits adaption of an active noise cancellation system for use as a muffler on a motor vehicle by providing a two stage cancellation method for cancelling sound pressure pulses as well as apparatus employed in each stage. In general, a preconditioning apparatus pneumatically reduces the crest factor of the sound pressure pulse train being transmitted through the exhaust conduit. For example, a vacuum source such as the intake manifold of a motor vehicle engine can be coupled through a valve actuated in response to tracking pulses to communicate with the exhaust conduit. The second stage comprises a conventional noise attenuation system in which a sensor provides a signal to an electronic control which generates a signal for driving the transducer to emit pulses 180° out of phase with the reduced sound pressure pulse train passing through the conduit. Nevertheless, the first stage permits the control to have a smaller amplifier section and a correspondingly smaller transducer than required in previously known conventional noise attenuation systems. These advantages render the noise reduction system particularly adaptable for use in motor vehicles having an exhaust conduit where sound pressure pulses must be muffled.

In the preferred embodiment, the first stage includes means for pneumatically reducing the peaks of the sound pressure pulses generated into the exhaust conduit. A vacuum source such as the engine manifold is coupled through a conduit to an electronic injector receiving a control pulse from the electronic control. The outlet of the injector communicates with the exhaust conduit at a predetermined point so that the control signal pulses responsive to a tracking signal introduces a vacuum or negative pulse into the conduit when a positive pressure pulse is passing through the conduit at that predetermined location. This pneumatic reduction of the pulse substantially reduces the power required at the transducer and the amplifier section of the electronic control driving the transducer.

Preferably, the tracking signal for driving the injector is derived from a sensor such as the microphone typically utilized in active noise attenuation systems. Alternatively, the tracking signal may be derived from an engine driven component such as a magneto. Furthermore, the tracking signal might be derived from an electronic control unit including a microcomputer processor and commonly employed on conventional motor vehicle engines. Furthermore, a combination of these tracking devices can be employed.

As a result, the present invention is particularly advantageous for adapting an active noise cancellation system to a motor vehicle for muffling the exhaust conduit. The reduced power necessary to cancel the source sound pressure pulses results in a substantially less costly amplifier section and a substantially more economical transducer. Moreover, the size requirements of each of these components is reduced and renders the apparatus more particularly adaptable to motor vehicle packaging for exhaust conduit muffling.

BRIEF DESCRIPTION OF THE DRAWING

The present invention will be more clearly understood by reference to the following detailed description in which like reference characters refer to like parts throughout the view and in which:

FIG. 1 is a diagrammatic plan view of a two stage active attenuation muffler constructed in accordance with the present invention;

FIG. 2 is a graphical representation of sound pressure pulses transmitted through the exhaust conduit of FIG. 1;

FIG. 3 is a graphical representation of an pneumatic pulse waveform generated in the first stage of the system according to the present invention;

FIG. 4 is a graphical representation of the resulting waveform exiting stage one of the noise cancellation system according to the present invention;

BEST MODE FOR CARRYING OUT THE INVENTION

Figure 5:
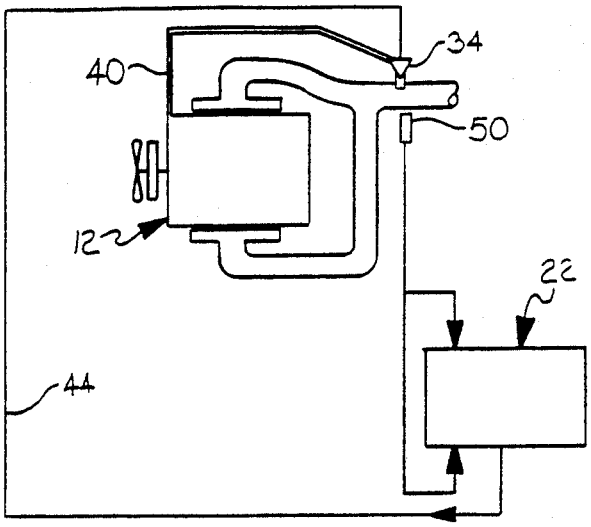
FIG. 5 is a fragmentary view similar to FIG. 1 but showing a particular embodiment of tracking apparatus for use with the present invention.

Referring first to FIG. 1, a motor vehicle exhaust system 10 is thereshown comprising a motor diagrammatically indicated at 12 and having combustion cylinder exhaust ports communicating with exhaust headers 14 and 16, both of which are coupled to a collector conduit 18. As in conventionally known noise cancellation systems used for building ducts, a tracking source 20 inputs a signal representative of the pulse train travelling through the conduit 18. The signal is fed into an electronic control 22 used to drive a transducer 24. The transducer 24 is acoustically coupled to the conduit 18 as diagrammatically shown at 26. The electronic control includes an adaptive filter 28 and a power amplifier 30. In addition to the input signal from the tracking source 20, the adaptive filter preferably also receives a feedback signal from an error tracking source 32 such as a microphone for detecting the effect of the transducer upon the pulse train in the conduit 18 downstream of the transducer 24. As a result, the output of the transducer 24 is continually changed in accordance with the changes which occur in generation of the pulse train travelling through the conduit 18 in a manner well known to those skilled in the art of noise cancellation and duct systems.

The present invention provides a preconditioning circuit 33 for reducing the amplitude of the signals being transmitted through the conduit 18. As also shown in FIG. 1, preconditioning of the pulse train in the conduit 18 may be done pneumatically so as to physically reduce the pulses travelling through the conduit 18. An electronically controlled injector 34, such as one which operates in the manner of electronic fuel injectors in conventional production motor vehicles, has a fluid outlet in communication with the conduit 18. Injector 34 also has an inlet coupled through a vacuum line 40 to communicate with a vacuum source. In the preferred embodiment, the vacuum source is diagrammatically indicated as the intake manifold 42 of the engine 12.

Communication between the vacuum source at the inlet of the injector 34 and the outlet of the injector 34 is controlled by a control line 44 receiving a one-bit digital signal from a pulse width modulator 46 in the electronic control 22. The output from the pulse width modulator 46 through control line 44 is controlled by an input to the pulse width modulator 46 from the tracking source 20.

The effect of the preconditioning circuit 33 is best described with reference to FIGS. 2–4. In FIG. 2, sound pressure waveform delivered by the engine to the conduit 18 is illustrated as a series of pulses. In general, each pulse reaches a peak quickly as the valve opens in the valved port of an engine cylinder and causes a rush of exhaust gases to escape from the cylinder. The pulse decays more slowly as combustion gases continue to be a exhausted from the cylinder by the piston. The very high peak values of the sound pressure pulses also require corresponding peak pulses to be generated at the transducer 24. As a result, the acoustic actuator comprising power amplifier 30 and the transducer 24 must be sufficiently powerful to generate and transmit these peak value acoustic pulses.

In the operation of the preconditioning circuit 33, the tracking signal from the tracking source 20 provides a phased input to a pulse width modulator that generates a one-bit pulse width modulated (PWM) digital output to the injector 34 through the control line 44. Thus, so long as the digital bit is positive, the outlet of the injector 34 communicates with the vacuum source such as the intake manifold 32. The result is that a series of vacuum pulses, designated as negative pressure pulses in FIG. 3, reduces the peak of the pulses delivered through the conduit 18. Accordingly, the crest factor of the pulse train, and the power requirements of the cancellation system, are reduced.

The interaction of the vacuum pulses and the exhaust sound pressure pulses is diagrammatically illustrated in FIG. 4 as a subtraction of the vacuum pulses shown in FIG. 3 from the sound pressure pulses designated in FIG. 2. Of course, the vacuum pulses have a substantially shorter time duration than the exhaust pulses so that the peaks of the sound pressure pulses are reduced without affecting the phase of the resulting waveforms shown in FIG. 4.

Referring now to FIG. 5, a particularly useful means for deriving a tracking signal responds to the pulses transmitted through the conduit 18. A microphone 50 forms an input sensor, as in previously known sound cancellation systems, to provide an input to the electronic control circuit 22. However, unlike previously known inputs delivered to the adaptive filter circuit, the sensor signal is also delivered to the pulse width modulator 46 adaptively creating a single bit control signal 44 to the injector 34. As discussed above, the narrow width vacuum pulses as shown in FIG. 3 do not affect the phase of the pulses travelling through the conduit 18. As a result, placement of the microphone 50 at a conduit position downstream of the injector 34 does not affect the phase of the pulse signals and thus does not affect the previously known functions of the electronic control 22. Moreover, the signal sensed at the microphone 50 is very closely related to pulses which must be cancelled at the transducer 24.

Figure 6:
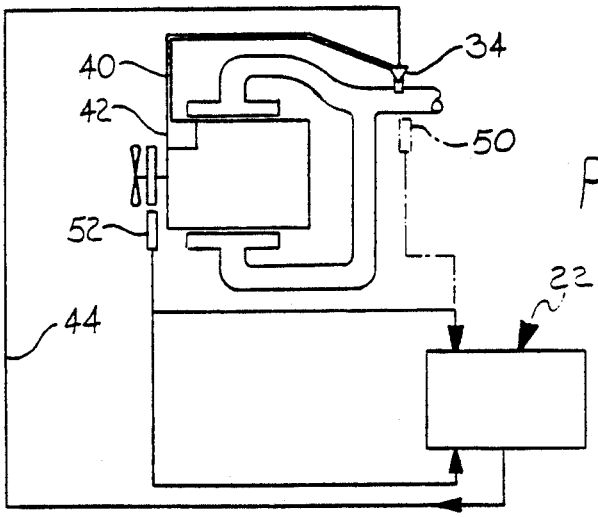
FIG. 6 is a view similar to FIG. 5 but showing a further modification of a tracking apparatus according to the present invention.

As shown in FIG. 6, the tracking source 20 includes an engine driven component such as a magneto 52. For example, a pulley driven generator may be used to provide pulses indicative of engine speed and thus, related to the opening and closing of the valves generating the pulses through conduit 18. Such a tracking source provides the advantage that the sensor need not be subjected to exposure to the temperature conditions and the exposed position of the exhaust conduits on motor vehicles.

It is also desirable that the tracking source 20 might involve a combination of sensors such as the engine driven magneto 52 and the microphone 50. For example, the microphone 50 might be used as a source input for the adaptive filter portion of the electronic control 22, since the transducer output must more closely track the waveform passing through the conduit. At the same time, the pulse width modulator 46 is driven by the engine driven accessory, since precise centering or alignment of the narrow suction pulse within the exhaust sound pressure pulse is not required. Furthermore, the timing of the tracking device 52 might be phased differently than the tracking signal provided by the sensor 50 in order to compensate for losses which may occur in the pneumatic portion of the system. For example, any time lapse in generating the pressure source vacuum at the outlet of the injector 34 may be compensated for by appropriate phasing of the signal generated by the engine driven accessory.

Figure 7:
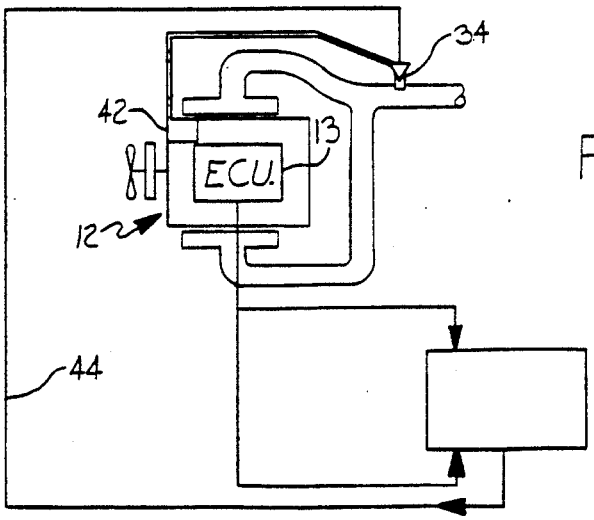
FIG. 7 is a view similar to FIGS. 5 and 6 but showing a further modification of the tracking apparatus in accordance with the present invention.

In addition, as shown in FIG. 7, the tracking signal may be provided by an electronic source of the engine 12. Since an engine driven accessory 52 as shown in FIG. 6 is operated by the engine, such a sensor reduces available engine power, and also adds to the number of components which must be provided for the motor vehicle. The tracking apparatus shown in FIG. 7 avoids the cost of additional components for implementation of the active muffler system by utilizing a signal tap on the electronic control unit 13 used to control engine operation including the electronic control of the fuel injectors used with conventional production vehicles. Although such a system may introduce a larger discrepancy between the pulses actually passing through the conduit 18 and the tracking signal controlling the electronic control 22, it provides a substantially less expensive and more efficient manner for controlling the active noise cancellation system.

In any event, it will be understood that the present invention enables previously known noise cancellation technology to be employed with motor vehicles in a cost effective manner. In particular, the amplitude of cancellation pulses which must be generated at the acoustic actuator is substantially reduced. As a result, the power generating capacity of the amplifier 30 and the power capacity of the transducer 24 can be substantially reduced over previously known noise cancellation systems. As a result, such a system is more likely to satisfy the packaging requirements of a motor vehicle. Moreover, substantial cost reduction in the components required to amplify the signal from the adaptive filter enables the system to be more readily adapted to the mass production of motor vehicles.

Having thus described the present invention, many modifications thereto will become apparent to those skilled in the art to which it pertains without departing from the scope and spirit of the present invention as defined in the appended claims.

I claim:

1. An active noise attenuation muffler for a motor vehicle engine exhaust conduit comprising:

a tracking source for generating a tracking signal representative of an input pulse train;

a transducer coupled to said conduit;

electronic control means for driving said transducer in response to said tracking signal and producing an output pulse train having a phase opposite to said input pulse train at a predetermined point along said conduit; and means for pneumatically reducing the crest factor of said input pulse train.

2. The invention as defined in claim 1 wherein said means for pneumatically reducing the crest factor of said input pulse train comprises a valve having an inlet and an outlet;

a vacuum source coupled to said inlet, said outlet being coupled in communication with the engine exhaust conduit, and a control for opening said valve during each pulse of the input pulse train to introduce a negative pressure pulse that reduces the crest factor of the input pulse train.

3. The invention as defined in claim 2 wherein said control comprises:

a tracking source for generating a tracking signal responsive to engine operation; and a pulse width modulator for generating a control signal in response to said tracking signal.

4. The invention as defined in claim 3 wherein said tracking source comprises a microphone.

5. The invention as defined in claim 3 wherein said tracking source comprises an engine driven accessory.

6. The invention as defined in claim 3 wherein said tracking source comprises an electronic control unit of the motor vehicle engine.

7. The invention as defined in claim 2 wherein said control comprises a pulse width modulator responsive to said tracking signal.

8. A method for muffling engine exhaust conduits comprising:

tracking engine speed to generate a tracking signal representative of sound pressure waveforms introduced to the exhaust conduit;

controlling the operation of a transducer emitting noise cancellation signals in said exhaust conduit in response to said tracking signal; and preconditioning said sound pressure pulses by introducing negative pressure pulses into said conduit in response to said tracking signal.

9. The invention as defined in claim 5 wherein said preconditioning step comprises intermittently coupling a vacuum source in fluid communication with the exhaust conduit; and actuating said valve in response to said sensor signal.

* * * * *

UNITED STATES PATENT AND TRADEMARK OFFICE

CERTIFICATE OF CORRECTION

PATENT NO. : 5,063,598

DATED : November 5, 1991

INVENTOR(S) : Earl R. Geddes

It is certified that error appears in the above-identified patent and that said Letters Patent is hereby corrected as shown below:

Column 6, line 50 (Claim 9), delete "5" and substitute --8--.

Signed and Sealed this

Twenty-third Day of February, 1993

*Attest:*

STEPHEN G. KUNIN

*Attesting Officer*

*Acting Commissioner of Patents and Trademarks*